US007823801B2

(12) United States Patent
McGarry et al.

(10) Patent No.: US 7,823,801 B2
(45) Date of Patent: Nov. 2, 2010

(54) FIREFIGHTING DEVICE WITH LIGHT EMITTING COMPONENT

(75) Inventors: Kiernan McGarry, Hernando, FL (US); Todd Lozier, Elkhart, IN (US)

(73) Assignee: Elkhart Brass Manufacturing Company, Inc., Elkhart, IN (US)

( * ) Notice: Subject to any disclaimer, the term of this patent is extended or adjusted under 35 U.S.C. 154(b) by 319 days.

(21) Appl. No.: 11/541,296

(22) Filed: Sep. 29, 2006

(65) Prior Publication Data

US 2007/0080244 A1 Apr. 12, 2007

Related U.S. Application Data

(60) Provisional application No. 60/724,823, filed on Oct. 7, 2005.

(51) Int. Cl.
*F21S 8/00* (2006.01)

(52) U.S. Cl. ..... 239/18; 239/289; 239/525; 239/548; 362/96; 362/84; 362/101; 169/51

(58) Field of Classification Search ..... 239/451–460, 239/525–526, 18, 548, 289; 362/96, 34, 362/84; 169/51, 37
See application file for complete search history.

(56) References Cited

U.S. PATENT DOCUMENTS

| | | | | |
|---|---|---|---|---|
| 2,071,242 | A * | 2/1937 | Todd et al. | 362/96 |
| 2,307,014 | A * | 1/1943 | Becker et al. | 239/438 |
| 2,629,516 | A | 2/1953 | Badham | 222/79 |
| 2,747,939 | A * | 5/1956 | Caird | 239/456 |
| 2,806,741 | A * | 9/1957 | Fishelson et al. | 239/456 |
| 2,855,497 | A | 10/1958 | Bacon | 240/6.4 |
| 3,784,113 | A * | 1/1974 | Specht | 239/460 |
| 4,252,278 | A * | 2/1981 | McMillan | 239/583 |
| 4,283,757 | A * | 8/1981 | Nalbandian et al. | 362/120 |
| 4,348,715 | A * | 9/1982 | Christensen et al. | 362/109 |
| 4,469,279 | A * | 9/1984 | Allenbaugh, Jr. | 239/453 |
| 4,653,693 | A * | 3/1987 | Steingass | 239/460 |
| 4,729,070 | A * | 3/1988 | Chiu | 362/33 |
| 5,239,451 | A * | 8/1993 | Menke et al. | 362/199 |
| 5,329,637 | A | 7/1994 | Walker | 2/5 |
| 5,564,128 | A | 10/1996 | Richardson | 2/422 |
| 5,795,053 | A | 8/1998 | Pierce | 362/96 |
| 5,873,647 | A | 2/1999 | Kurtz et al. | 362/96 |
| 6,116,520 | A | 9/2000 | Lee | 239/289 |
| 6,257,750 | B1 | 7/2001 | Strasser et al. | 362/559 |
| 6,439,472 | B1 * | 8/2002 | Lin et al. | 239/18 |
| 6,450,677 | B1 * | 9/2002 | Knauer et al. | 362/551 |
| 6,637,676 | B2 | 10/2003 | Zieger et al. | 239/548 |
| 6,988,693 | B2 * | 1/2006 | Shelly | 244/135 A |
| 7,036,770 | B2 * | 5/2006 | Shelly et al. | 244/135 A |
| 2005/0237742 | A1 | 10/2005 | Wang | |

FOREIGN PATENT DOCUMENTS

| | | |
|---|---|---|
| JP | 2004132443 | 4/2004 |
| JP | 2004305502 | 11/2004 |

* cited by examiner

*Primary Examiner*—Dinh Q Nguyen
(74) *Attorney, Agent, or Firm*—Van Dyke, Gardner, Linn & Burkhart, LLP

(57) ABSTRACT

A firefighting device comprising includes a device body with a fluid passage through which a fluid flows when the firefighting device is in operation and at least one molded body. At least a portion of the molded body is at least translucent and encloses therein or covers a light emitting source. When light is emitted from the light emitting source, light is emitted from the molded body to thereby illuminate the firefighting device.

3 Claims, 6 Drawing Sheets

FIREFIGHTING DEVICE WITH LIGHT EMITTING COMPONENT

CROSS-REFERENCE TO RELATED APPLICATIONS

This application claims the benefit and priority to Provisional Application Ser. No. 60/724,823, filed Oct. 7, 2005, entitled FIREFIGHTING DEVICE WITH LIGHT EMITTING COMPONENT, and is incorporated by reference herein in its entirety.

TECHNICAL FIELD AND BACKGROUND OF THE INVENTION

The present invention relates to components for firefighting devices and, more particularly, to molded components or accessories that are attached to firefighting devices, such as nozzles, monitors, fire hoses, gated wyes, or the like.

Firefighting nozzles, both handline and master stream device nozzles, generally have a molded rubber, elastomer or polymer bumper attached to the exterior of the nozzle exit. As nozzles tend to be made of either aluminum or brass, both comparatively soft materials and subject to impact damage, the bumper serves to protect the end of the nozzles from incidental damage. Nozzle bumpers are generally available in a variety of colors to assist with color coding of water delivery streams. For example, the controls, fire truck outlet, hose, and nozzle for a given discharge are often made from matching colors for easy identification during fire ground operations.

During fire ground operations, specifically during interior fire attack and suppression, visibility is nearly non-existent. Interior areas affected by fire will almost certainly be without electrical power because one of the first activities of a fire department responding to a call is to disconnect electrical power from the structure. Smoke and soot create a black cloud that fully encompasses a room or rooms. It is expected that during interior operations, firefighters will struggle to see their hands in front of their faces.

Lights and reflective tape/labels on clothing and equipment provide some assistance in creating visual reference during interior operations. However, reflective tape/labels require the presence of a light—one additional item that a fire fighter must carry into an unknown and dangerous area. Because interior attack can be extremely dangerous, firefighters are taught never to separate from their hose line or their partners. Your partner is your assistance—and your hose line is your return path to get out of the structure. However, in an event such as a partial collapse of the structure, it is possible that fire fighters can become temporarily separated from each other and their equipment.

SUMMARY OF THE INVENTION

According to the present invention, a component is provided that increases the visibility of firefighting devices or equipment to which the component is mounted to thereby increase the safety of the fire fighters particularly during an interior fire attack and suppression where visibility is severely reduced if not non-existent.

In one form of the invention, a firefighting device includes a device body with a fluid passage through which a fluid flows when the firefighting device is in operation. The device body includes at least one molded body. For example, suitable materials for the molded body may include a rubber, an elastomer or a polymer material. At least a portion of the molded body is at least translucent and encloses therein or covers a light emitting source. Light emitted from the light emitting source is emitted from the molded body to illuminate the firefighting device.

In one aspect, the light emitting source comprises a powered light emitting source. The firefighting device may also include a voltage source for powering the powered light emitting source. For example, the voltage source may be encapsulated in the molded body. A suitable powered light emitting source may include one or more light emitting diodes. Other suitable light emitting sources may include a chemically activated luminescent cell, luminescent bodies, or luminescent paint, which are charged by light.

In another aspect, the firefighting device may comprise a nozzle, a monitor, a gated wye, a hose, or the like.

In yet other aspects, the molded body may comprise a bumper, a handle grip, a hand grip, or a hose coupler.

In another form of the invention, a firefighting nozzle includes a nozzle body with a fluid passage through which a fluid flows when the nozzle is in operation. The nozzle body includes at least one molded body. For example, the body may be molded from a rubber, an elastomer or a polymer material, which is at least translucent. The firefighting nozzle also includes a light emitting source. Light emitted from the light emitting source is emitted from the molded body, which either covers or encapsulates the light emitting source, to illuminate the firefighting nozzle.

In one aspect, the light emitting source is selectively actuated to emit the light. For example, the light emitting source may comprise a powered light emitting source, such as at least one light emitting diode.

In another aspect, the light emitting source is enclosed in the molded body. For example, the light emitting source may be located in a cavity formed in the body and, further, may be molded therein with the molded body. Alternately, the light emitting source may be mounted to the nozzle with the molded body overlaying the light emitting source.

Accordingly, the present invention provides a firefighting component that can provide a tangible increase to firefighting safety to make the firefighting device or equipment to which the firefighting component is mounted more visible during a low light or no-light condition.

DETAILED DESCRIPTION OF THE DRAWINGS

DETAILED DESCRIPTION OF THE PREFERRED EMBODIMENTS

Figure 1:
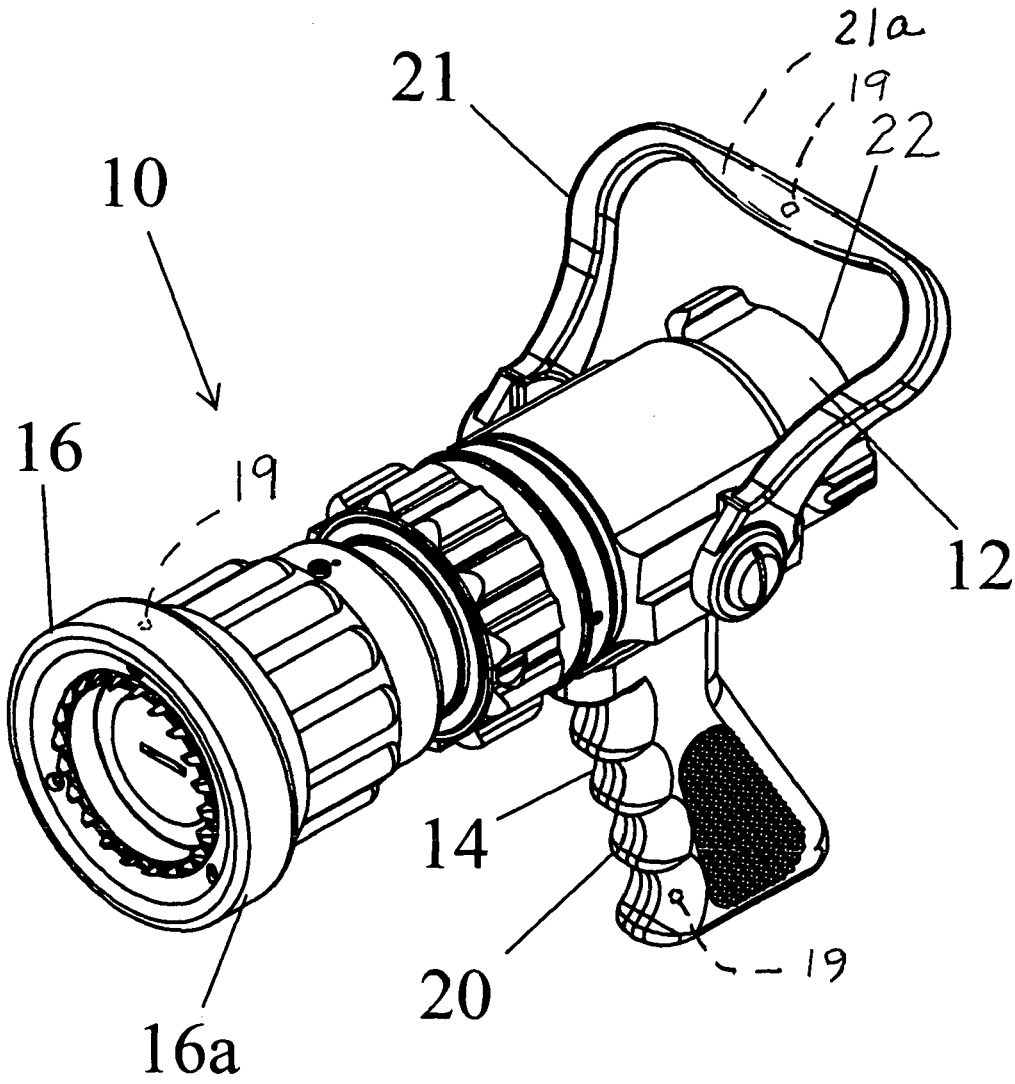
FIG. 1 is a perspective view of a firefighting device incorporating one or more molded components of the present invention with one in the form of a molded bumper.

Referring to FIG. 1, the numeral 10 generally designates a nozzle. As will be more fully described below, nozzle 10 includes one or more molded components that are adapted to emit light from a light source to enhance the safety to firefighters in the region of the nozzle by providing them a greater ability to locate the nozzle and their equipment and potentially locate a path to exit the structure. While the present invention is described in reference to a nozzle, it should be understood that the invention may be incorporated in other firefighting devices such as monitors, hoses, gated wyes, or the like.

Figure 1A:
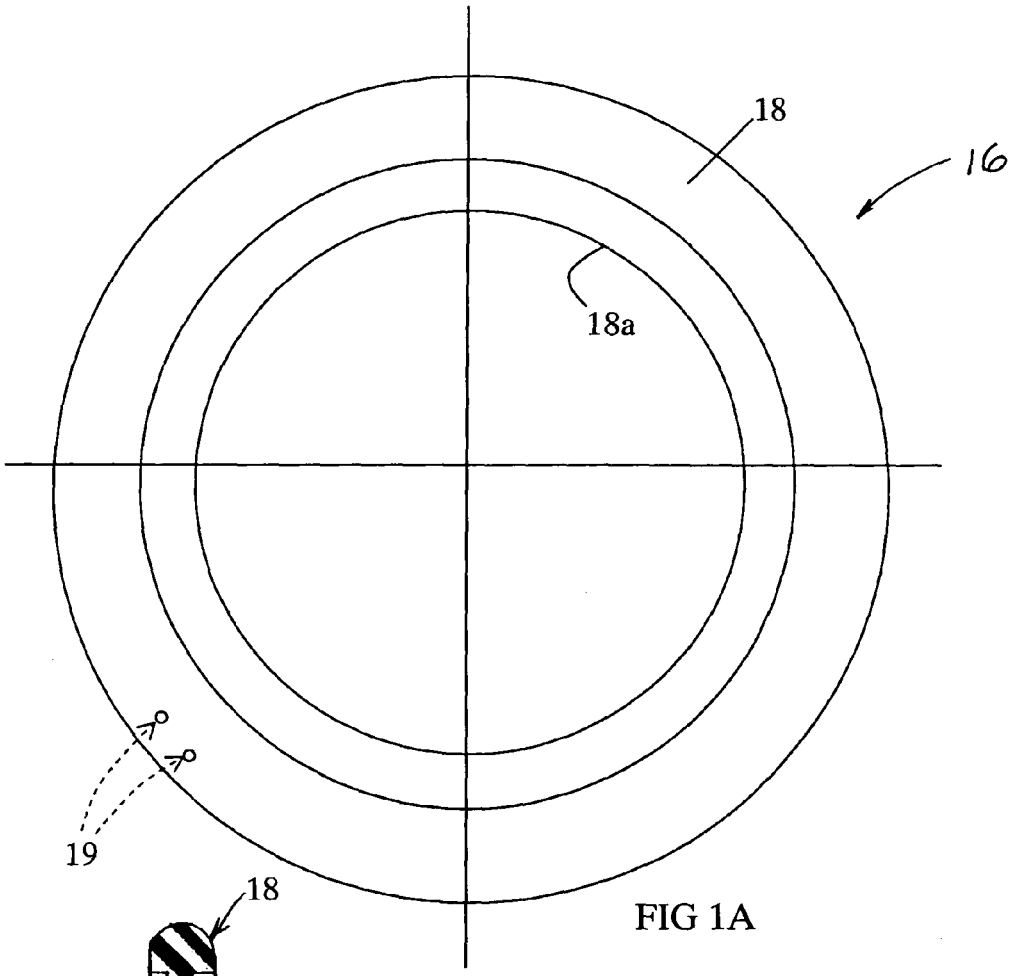
FIG. 1A is an enlarged plan view of the bumper of FIG. 1.
Figure 1B:
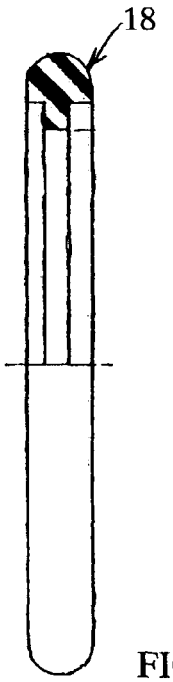
FIG. 1B is a partial fragmentary side view of the bumper of FIG. 1A.

In the illustrated embodiment, nozzle 10 comprises a handline nozzle. Nozzle 10 includes a nozzle body 12 with a handle 14 and a bumper 16, which is mounted to the nozzle at the nozzle exit. Nozzle body 12 is typically formed from brass or aluminum and, therefore, subject to impact damage unless protected, for example, by bumper 16. Referring to FIGS. 1A and 1B, bumper 16 comprises an annular body 18 with an annular recess 18*a* for mounting the bumper onto the nozzle body 12. Optionally, though not illustrated, bumper 16 may incorporate molded teeth for creating a fog spray pattern.

Bumper 16 comprises a molded body 16*a* molded from an impact absorbing material, such as a molded rubber, elastomer, or polymer body, which provides impact absorption to the nozzle body in the event that the nozzle body is subject to an impact force. Bumper 16 serves to protect the end of the nozzle from accidental damage. For example, a suitable bumper material comprises a EPDM rubber with a durometer in a range of, for example, 60 to 70. Another suitable material includes a Santoprene material. Furthermore, at least a portion of the bumper material is translucent or even transparent so that light can be emitted from or transmitted through bumper 16, as will be described below. However, in order for the bumper to have a color for color coding, bumper 16 is preferably formed from a translucent material.

Figure 1C:
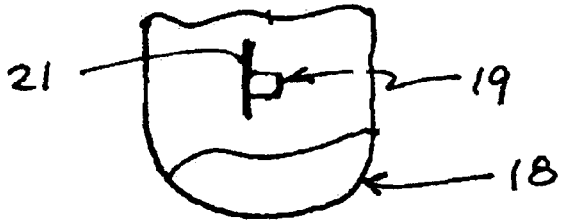
FIG. 1C is an enlarged partial fragmentary view of the bumper illustrating an LED as a light emitting source.

In addition, bumper 16 incorporates one or more light emitting sources 19 (FIGS. 1A and 1C). For example, the light emitting source may be encapsulated within the bumper and, further, molded therein so as to imbed the light emitting source in the bumper. In one embodiment, incorporated within the bumper is a light emitting source 19, such as an LED, or a chemically activated luminescent cell, such as a glow stick, or the like. Alternately, body 16*a* may have molded therein luminescent bodies that are charged by light, either natural light or interior fluorescent lighting, which is external to the bumper, and which thereafter for a given length of time emit light. In yet another form, the bumper may have a luminescent paint applied to its outer surface or to its inner surface (the surface facing the nozzle), which luminescent paint is similarly charged by light. The light emittance time of luminescent paint varies with the type of paint and the charge time (time exposed to light) but may last several hours or more. In this manner, the bumper is adapted to emit light without the need for an external light source other than possibly to charge the light emitting source before it is used, which significantly increases the safety to a firefighter by providing a means to make the bumper visible in reduced or no light lighting conditions.

When the light emitting source comprises an electrically driven light source, such as an LED, a relatively small battery and circuit may be included with the light source in the bumper. For example, bumper 16 may incorporate a circuit board 21 (FIG. 1C) with the voltage supply, such as a battery, and electric drive circuit, as well as the LED or LEDs mounted thereon. Optionally, the circuit may include a switch. For example, the switch may be provided at the surface of the bumper or just below the surface of the bumper.

When molding an electronic light emitting source in the bumper, bumper 16 is preferably therefore formed from a low temperature molding process, such as reaction injection molding (RIM) so as not to destroy or deteriorate the electronics. Alternately, bumper 16 may be molded with a recess or cavity, such as a lipped recess or lipped cavity, formed therein with the light source then incorporated in the bumper by implanting the light emitting source in the recess or cavity. For example, the light emitting source may comprise a module that is configured so that it can be inserted and removed from the bumper, for example, for repair, recharging or replacement. Optionally, a press fit may be provided between the bumper and the module.

In another form, the light emitting source may be mounted to the nozzle body, with the bumper's translucent or transparent material allowing the light from the light source to be transmitted through and emitted from the outer surface of the bumper. For example, luminescent paint may be applied to the nozzle, for example, in the area behind the bumper. Similarly, a powered, electrically driven light emitting source may be mounted to the nozzle, in which case the switch to activate the light emitting source may be provided on the nozzle body apart and spaced from or adjacent the bumper.

As would be understood, because the light source emits light, which light source is embedded or otherwise covered by the bumper, the bumper is in-effect self-illuminating without the need for an external light source contemporaneous with the nozzle's use to illuminate the bumper, as in the case of reflective tapes or the like. Even with the luminescent bodies or paint, although the bodies or paint may require charging by an external light source, they continue to emit light after the light source is removed and therefore when being used do not need the external light source. Therefore, even though an external light source may be needed in a luminescent paint or body application, it is not needed to maintain the light emittance from the bumper, for example. Because a nozzle is the firefighter's source of water and attached to a hose, which is the path out of the structure, by providing a bumper that emits light, not only can the firefighter locate the nozzle, the firefighter may also be able to find a path out of the structure during an emergency condition.

Optionally, other molded components on the nozzle may be adapted to emit light. For example, nozzle 10 may include a hose coupler 22 or a handle grip 20, which is formed from a molded material similar and may similarly incorporate or overlay one or more light emitting sources, as described in reference to bumper 16. In addition, in the illustrated embodiment, nozzle 10 includes a pivotal, shut-off handle 21, which may be provided with a handle grip 21*a* that is molded in a similar fashion to bumper 16 with one or more light emitting sources embedded therein or covered by the handle grip. As would be understood, other components or accessories may be molded according to the present invention.

Figure 2:
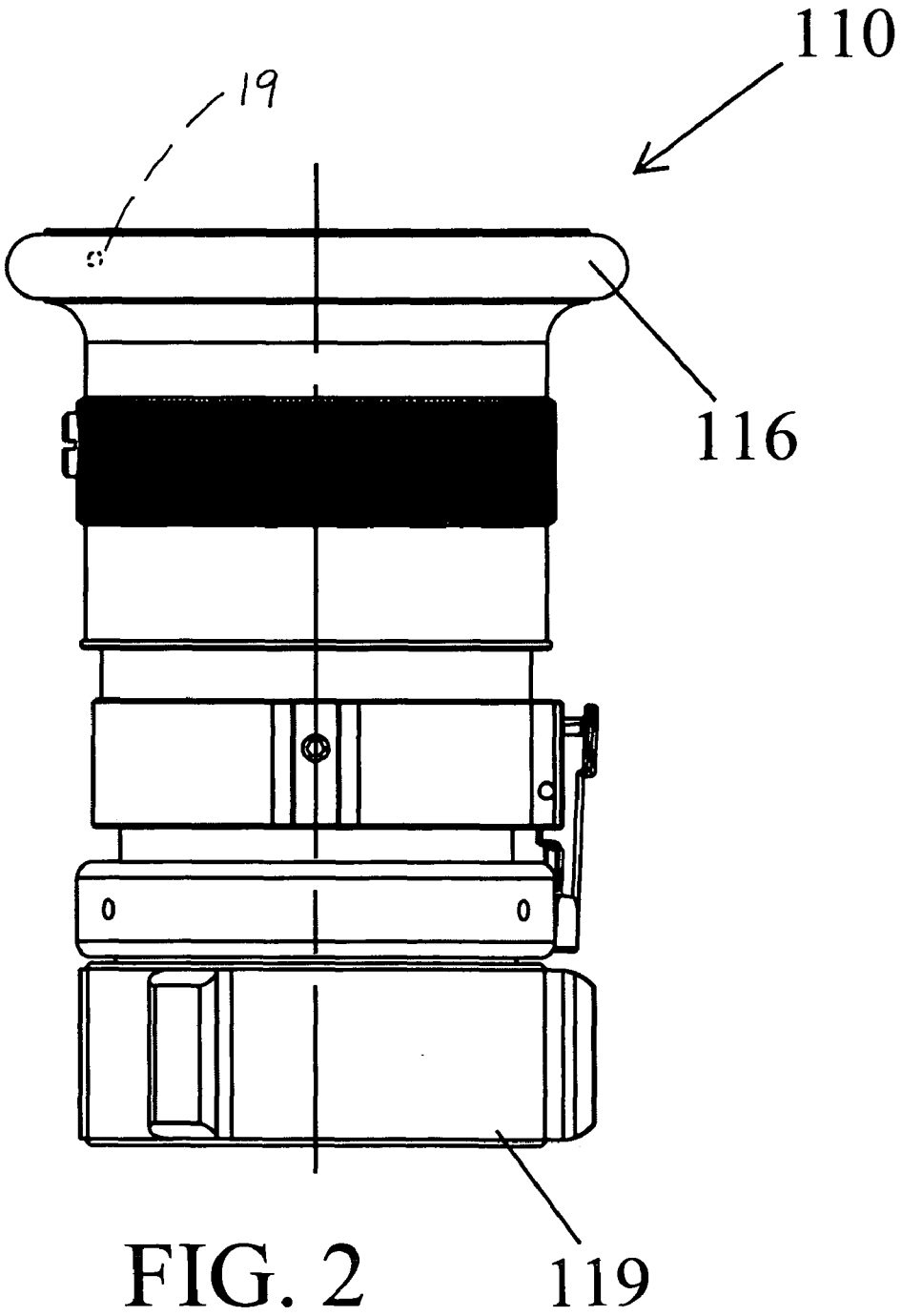
FIG. 2 is a perspective view of another embodiment of a nozzle incorporating a molded bumper of the present invention.

Referring to FIG. 2, the numeral 110 generally designates another embodiment of a nozzle incorporating a bumper 116 and a hose coupler 119, which may be adapted to emit light in a similar manner to bumper 16.

Figure 3:
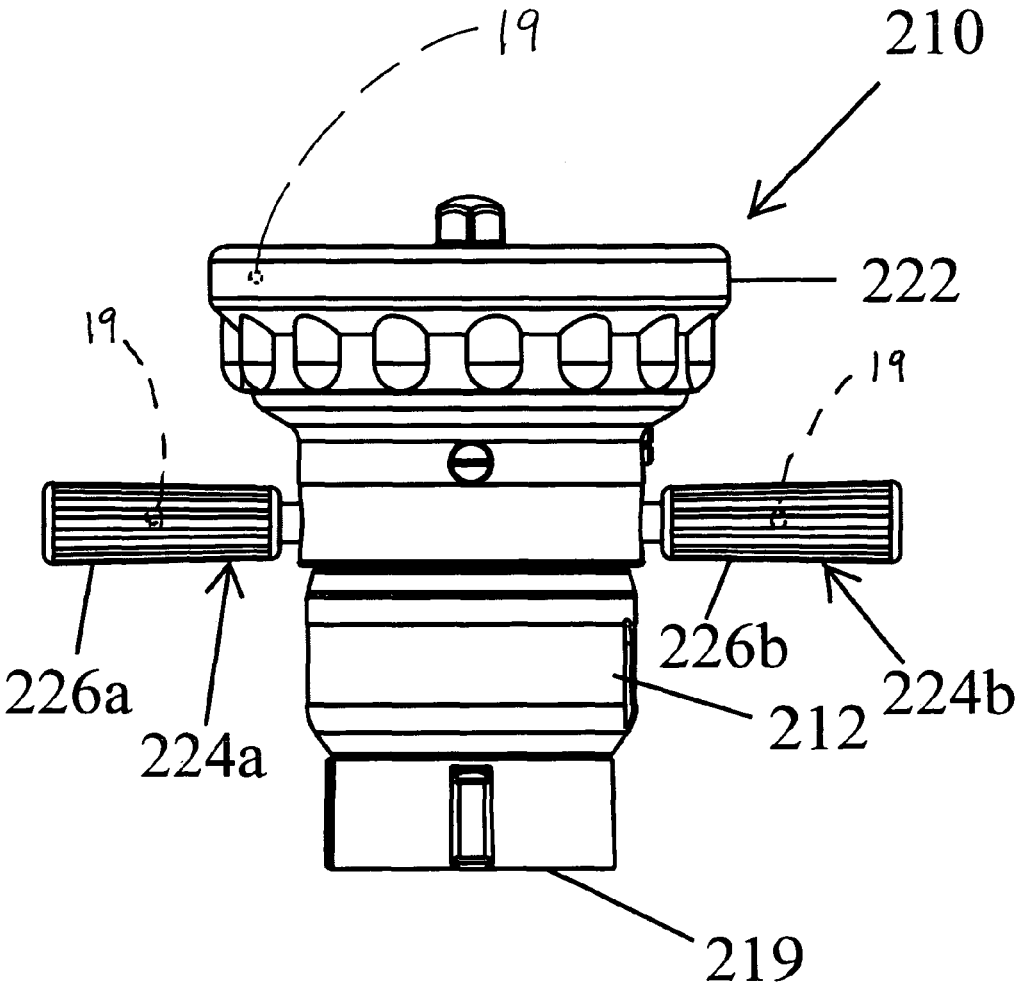
FIG. 3 is a perspective view of another embodiment of a nozzle incorporating molded components of the present invention in the form of a molded hand grip and handle grips.

Referring to FIG. 3, the numeral 210 generally designates a main line nozzle. Main line nozzle 210 incorporates a bumper 222, which is molded in a similar fashion to bumper 16 from an impact resistant material, such as a rubber, elastomer or polymer material, which may similarly incorporate one or more light emitting sources or cover one or more light emitting sources such that bumper 222 emits light in a similar manner to bumper 16.

Figure 3A:
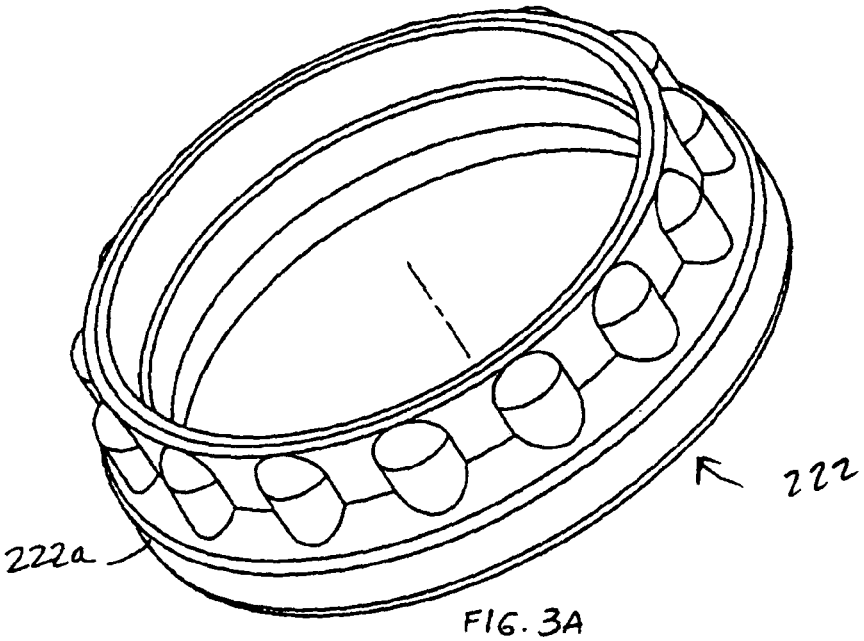
FIG. 3A is an enlarged perspective view of the hand grip of FIG. 3.
Figure 3B:
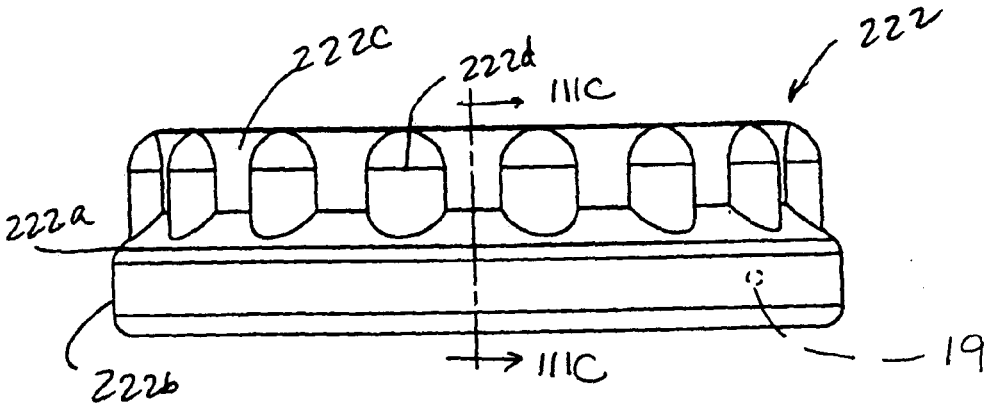
FIG. 3B is a side view of the hand grip of FIG. 3A.
Figure 3C:
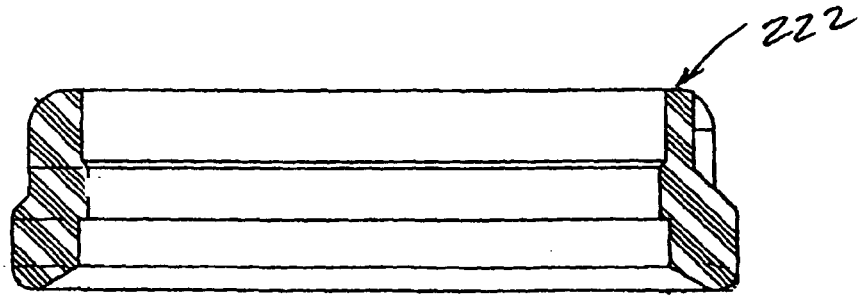
FIG. 3C is a cross-section view taken along line IIIC-IIIC of FIG. 3B.

Referring to FIGS. 3A-3C, bumper 222 comprises an annular body 222*a* with an enlarged shoulder 222*b* that extends around the nozzle body 212 exit. Extending inwardly from shoulder 222*b* is a cylindrical wall 222*c* with a plurality of raised ribs 222*d*. For example, the light emitting source may be provided in the body 222*a* at shoulder 222*b*, in cylindrical wall 222*c*, or in ribs 222*d* or in several places within body 222*a*.

Referring again to FIG. 3, nozzle 210 includes a hose coupler 219 and a pair of handles 224*a* and 224*b* each with a handle grip 226*a* and 226*b*. Coupler 219 and handle grips 226*a* and 226*b* may be similarly formed from a translucent or transparent, molded material, such as a rubber, elastomer, or polymer, such as EPDM or Santoprene, which incorporates or covers one or more light sources such that coupler 219 and/or handle grips 226*a* and 226*b* are similarly adapted to emit light.

Figure 4:
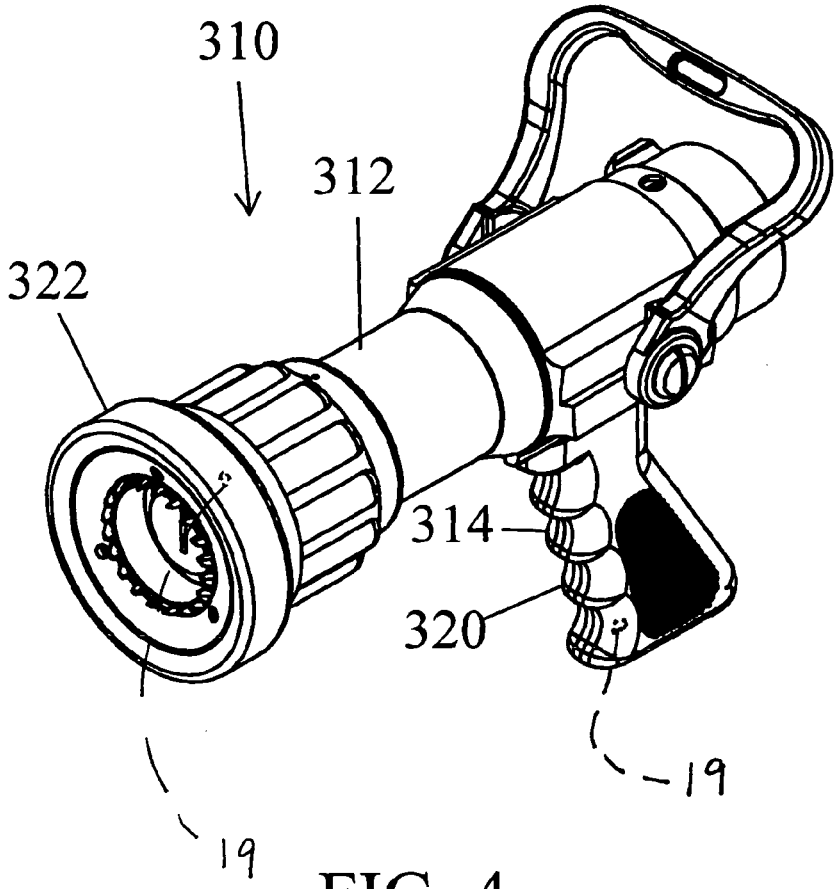
FIG. 4 is a perspective view of another embodiment of a nozzle incorporating one or more molded components of the present invention.

Referring to FIG. 4, the numeral 310 designates another embodiment of a nozzle. Nozzle 310 includes a nozzle body 312 and a handle 314 similar to nozzle 10. Mounted at the nozzle exit is a hand grip 322, which is optionally molded from a material similar to bumper 16 and, further provided with one or more light sources such that hand grip 322 emits light.

In addition, other firefighting devices that may incorporate molded components formed in the manner described above include gated wyes, hoses, or the like.

Consequently, the present invention provides a firefighting component that can provide a tangible increase to firefighting safety to make a firefighting device or equipment visible during a low light or no-light condition. As noted, these translucent or transparent components may be molded from a rubber, elastomer, or polymer material with the light source embedded into the component during molding or inserted therein or applied thereto after molding. Further, the translucent components may be molded with a color additive to maintain the color coding of the underlying device. Alternately, as noted the molded components may be configured to overlay one of more light emitting sources that are mounted or applied to the underlining firefighting device. As noted, the light emitting source may comprise a chemically activated luminescent cell, luminescent bodies or luminescent paint that can be charged by light, or an electrically operated light emitting source, such as an LED. Furthermore, each of the components may incorporate a plurality of such light emitting sources. As would be understood by those skilled in the art, the resulting light emitting components not only increase the safety during fire ground activities but without any attendant reduction in the ability of the component to provide damage protection to the underlying device such as a nozzle. When molded in the component the incorporation of such light sources does not change the existing mold tooling and, further, can be retrofitted onto existing firefighting devices. In the case of the molded electrical light emitting source, the wiring and electrical connections may be molded within the component body; therefore, there are no wiring or electrical connections that are subject to failure or disconnection. Further, because the molded component emits light and does not require an external electrical source to illuminate or maintain the illumination of the component, the firefighting devices incorporating the components of the present invention may be used without external charging means. As would be understood, the incorporation of the light source can be achieved without significantly increasing the weight or the complexity of existing product lines.

While several forms of the invention have been shown and described, other forms will now be apparent to those skilled in the art. For example, any one of the firefighting devices may have luminescent paint applied to other portions of the underlying device separate and apart from where the molded component is mounted. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

The embodiments of the invention in which an exclusive property right or privilege is claimed are defined as follows:

1. A firefighting nozzle comprising:

a nozzle body with a fluid passage and a nozzle outlet through which a fluid flows when said nozzle is in operation;

a molded bumper molded from an impact absorbing material mounted to the nozzle body, said molded bumper forming an annular impact absorbing body about said nozzle body at said nozzle outlet and at least a portion of said annular impact absorbing body being translucent; and a light emitting source either (1) encapsulated in said annular impact absorbing body or (2) positioned between said annular impact absorbing body and said nozzle body, said light emitting source comprising a chemically activated luminescent cell, a luminescent body, or luminescent paint, light emitted from said light emitting source illuminating said molded bumper to illuminate at least a portion of said firefighting nozzle such that said firefighting nozzle is self-illuminating to provide an increased visibility of said firefighting nozzle in a low light or no-light condition.

2. The firefighting nozzle according to claim 1, wherein said light emitting source is encapsulated in said molded body.

3. The firefighting nozzle according to claim 1, wherein said light emitting source comprises a plurality of luminescent bodies charged by light.

* * * * *